United States Patent [19]

McKinney

[11] Patent Number: 4,623,177

[45] Date of Patent: Nov. 18, 1986

[54] ADJUSTABLE SAFETY LATCH

[76] Inventor: James C. McKinney, 8850 N. Mount Dr., Alpharetta, Ga. 30201

[21] Appl. No.: 696,076

[22] Filed: Jan. 29, 1985

[51] Int. Cl.[4] ..... E05C 19/06

[52] U.S. Cl. ..... 292/87; 24/683; 248/544; 292/DIG. 60

[58] Field of Search ..... 292/80, 87, DIG. 60, 292/341.18, 341.19; 248/544, 496, 354.7; 24/586, 683, 685, 686

[56] References Cited

U.S. PATENT DOCUMENTS

| | | | |
|---|---|---|---|
| 2,042,297 | 5/1936 | Craighead | 292/87 |
| 2,485,189 | 10/1949 | Churchill | 292/80 |
| 2,565,636 | 8/1951 | Tinnerman | 292/80 X |
| 3,397,001 | 8/1968 | Friedman | 292/87 |
| 4,503,692 | 3/1985 | Grint | 292/DIG. 2 X |

FOREIGN PATENT DOCUMENTS

| | | | |
|---|---|---|---|
| 1194542 | 6/1965 | Fed. Rep. of Germany | 292/DIG. 44 |
| 2423191 | 12/1979 | France | 248/496 |

*Primary Examiner*—Robert L. Wolfe
*Assistant Examiner*—Russell W. Illich
*Attorney, Agent, or Firm*—James B. Middleton

[57] ABSTRACT

A child proof safety latch for a cabinet door or drawer. The safety latch includes a U-shaped mounting bracket that can be slipped over the edge of the door or drawer without screws or other fasteners. A hook assembly engages the mounting bracket with ratchet teeth so the hook member can be moved into locking position after the safety latch is in place on the closure. The hook member is carried on a base plate, and the base plate may have a knob to keep the hook assembly aligned for easy motion.

9 Claims, 6 Drawing Figures

ADJUSTABLE SAFETY LATCH

INFORMATION DISCLOSURE STATEMENT

It is known in the art to provide a safety latch for cabinet doors, drawers and the like, such latches being arranged to prevent a door or drawer from opening except very slightly. The safety latch can be disengaged by reaching through the partially open door or drawer and manipulating the latch to allow the door or drawer to open fully. While the disengagement of the safety latch is relatively easy for an adult, small children will not know how to manipulate the latch, and such latches tend to prevent a child from having access to the contents of a cabinet or a drawer.

While many such safety latches have been devised, and several such safety latches have been marketed, the latches are usually designed for a very specific cabinet arrangement so that a given latch will fit relatively few cabinet arrangements. Also, the prior art safety latches have generally required separate installation and adjustment of two or more pieces, and such adjustment within the confined spaces is quite difficult. If the latch is installed and is found to be improperly adjusted, one must remove or loosen the latch, make the desired adjustments, and retighten or reinstall the latch.

SUMMARY OF THE INVENTION

This invention relates generally to safety latches, and is more specifically concerned with a child proof safety latch for use on drawers, cabinet doors and the like.

The safety latch of the present invention includes a mounting bracket to be received over the edge of a closure, such as a door, drawer front or the like, and a hook member that is selectively carried by the bracket. The hook member is moveably mounted on the bracket such that the hook member can be urged into the desired position while the bracket is in place on the edge of the closure. In the preferred form of the invention, there is a ratchet means so arranged that the hook member can be moved up, the pawl portion moving over the ratchet teeth, but the angled ratchet teeth engage the pawl to allow the hook member to be placed in the desired location, and to remain in that location. The ratchet means is selectively releasable for adjustment of the hook member, the hook member being adjustable both while in place on a given closure and before installation on a closure.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figure 1:
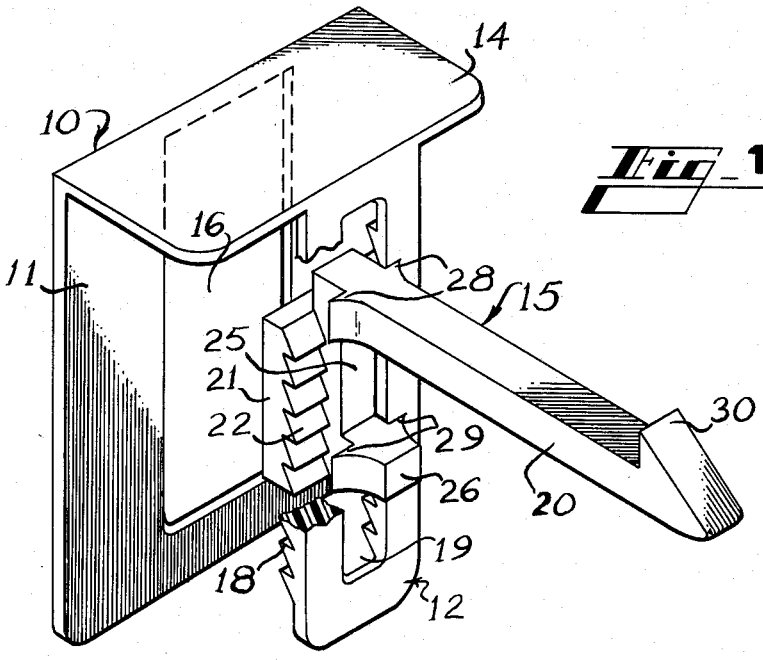
FIG. 1 is a perspective view of a safety latch made in accordance with the present invention, a portion of the bracket being broken away to show the construction of the hook assembly.

Referring now more particularly to the drawings, and to those embodiments of the invention here chosen by way of illustration, the latch shown in FIG. 1 includes a mounting bracket generally designated at 10, the bracket 10 including an outer flange 11 and a parallel inner flange 12. The outer flange 11 and the inner flange 12 are connected, and held in position by an end member 14.

While the safety latch shown in FIG. 1 includes the hook assembly 15, it will be seen that the hook assembly may be removed, and that the bracket 10 will be manufactured separately from the hook assembly 15.

Looking first at the mounting bracket 10 in more detail, it will be understood that the bracket 10 is relatively thin material, and may well be formed of sheet metal, plastic or other structural materials. As here illustrated, it is contemplated that the mounting bracket 10 will be formed of a plastic material, and may be injection molded. It will be seen that the outer flange 11 defines a central opening 16, and the inner flange 12 is aligned with the opening 16. With this arrangement, those skilled in the art will understand that the entire mounting bracket 10 can be injection molded as a one-piece unit, the ratchet teeth 18 on the rear surface of the inner flange 12 being also integrally molded at the same time.

While the opening 16 in the outer flange 11 is primarily for purposes of convenience in molding, it will be geen that there is also a central opening 19 in the inner flange 12. The opening 19 is designed to receive the hook member 20 of the hook assembly 15, and the opening 19 is elongated to provide for adjusting motion of the hook member 20.

Figure 2:
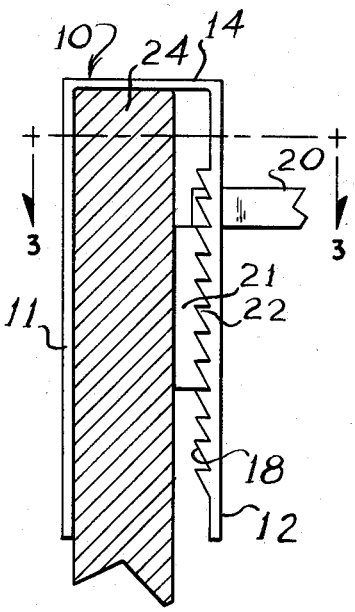
FIG. 2 is a side elevational view of the safety latch shown in FIG. 1, the bracket being received over the edge of a closure.
Figure 3:
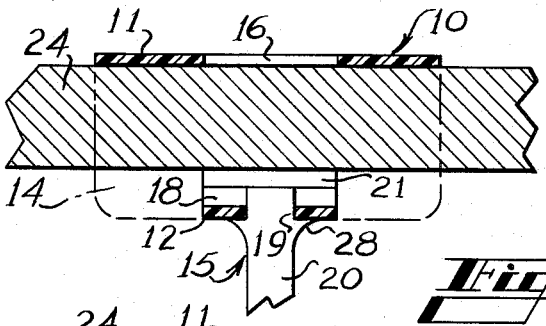
FIG. 3 is a cross-sectional view taken substantially along the line 3—3 in FIG. 2.

Looking now at the hook assembly 15, and with attention to FIGS. 1, 2 and 3 of the drawings, it will be seen that the hook assembly 15 includes a base plate 21 having ratchet teeth 22 formed on the face thereof. The hook member 20 extends generally perpendicularly from the plate 21.

While both the teeth 18 and the teeth 22 have been referred to as ratchet teeth, it will be obvious to those skilled in the art that a ratchet and pawl arrangement is provided, and either set of teeth 18 or 22 can be considered as the pawl. With this in mind, it will also be readily recognized that the pawl may have only one or two projections rather than the plurality of teeth shown in the drawings. For convenience, however, both sets of teeth will be referred to as ratchet teeth.

With the above in mind, and looking at FIG. 2 of the drawings, it will be seen that the hook member 20 can be placed through the opening 19 in the inner flange 12, and the ratchet teeth 22 on the base plate 21 can be engaged with the ratchet teeth 18 on the inner flange 12. With these parts appropriately positioned, the mounting bracket 10 can be placed over the edge of a closure designated at 24. Those skilled in the art will understand that closures such as the closure 24 are reasonably standard in thickness, so the end member 14 can be appropriately sized to place the outer flange 11 on one side of the closure 24, and the inner flange 12 will hold the base plate 21 against the other side of the closure 24. With such an arrangement, the ratchet teeth 18 and 22 will remain engaged so the hook assembly 15 will not easily move, and will move in only one direction even under reasonable force.

It is contemplated that the bracket 10 will be an elastic material such as an acrylic, nylon, acrylic copolymer or the like. With these, or numerous other materials, the inner flange 12 will be sufficiently resilient that the hook assembly 15 can be forcefully urged upwardly in the opening 19 with the bracket 10 in place over a closure 24 as is shown in FIG. 2 of the drawings.

From the foregoing description, it will be readily understood that the hook assembly 15 can be very simply constructed, consisting of only the base plate 21 having its ratchet teeth 22, and having a hook member 20 extending therefrom. While such an arrangement would be quite useable in accordance with the present invention, numerous modifications will also be useable, and may contribute to the operation of the invention. Thus, considering the arrangement of the inner flange 12, it will be apparent that the center portion of the base place 21 need not have ratchet teeth thereon, and a central area such as the area 25 can be utilized to assist in maintaining the hook assembly 15 in its proper orientation. As a further improvement, the hook assembly 15 may include a knob 26 extending from the base plate 21 through the opening 19. A knob such as the knob 26 can positively align the hook assembly 15, in conjunction with the hook member 20, to prevent canting of the hook assembly 15.

The preferred embodiment, as here illustrated, includes latch means for latching the hook assembly 15 into the opening 19. As is best shown in FIGS. 1 and 3 of the drawings, the hook member 20 includes latch members 28 on each side thereof, the latch members 28 taking the form of outwardly flared portions to abut the inner surface of the inner flange 12.

The knob 26 is formed like the base of the hook member 20, the knob 26 being formed with latch members 29.

Again, considering that the safety latch of the present invention will be formed of plastic or other somewhat elastic material, the hook member 20 and knob 26 can be placed through the opening 29. The outwardly flared portions of the hook member 20 and the knob 26 will tend to prevent the hook member 20 from completely seating within the opening 19; however, the latch members 28 and 29 are sufficiently small that the hook member 20 can be forcefully urged through the opening 19, and the latches 28 and 29 will snap into place. While the ratchet teeth 18 and 22 will generally prevent downward motion of the hook assembly 15, the direction of the teeth will allow upward motion of the hook assembly 15, though with some effort.

From the foregoing description, operation of the safety latch of the present invention should now be understandable. The hook assembly 15 would generally be assembled with the mounting bracket 10 by placing the hook member 20 through the opening 19 in the flange 12, with the hook assembly 15 at the bottom of the opening 19. By forcing the latches 28 and 29 through the opening 19 the hook assembly 15 will be properly mounted on the bracket 10. With the safety latch assembled, the bracket 10 can be placed over the edge of a closure such as the closure 24. The closure would then be moved towards the cabinet to the position in which the outer end 30 of the hook member 20 will engage some portion of the cabinet; and, with the closure member 24 held in this position, the knob 26 will be forcefully urged upwardly until the hook member 20 is positioned so the extending end 30 will engage the cabinet when the closure 24 is moved in a direction to open the cabinet.

With the safety latch of the present invention so installed, it will be understood that, when the closure 24 is opened, the end 30 of the hook member 20 will engage the cabinet and prevent opening of the closure 24. One can then reach through the partially open closure and depress the hook member 20, thereby allowing full opening of the closure 24.

Figure 4:
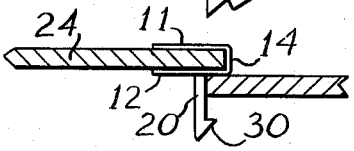
FIG. 4 is a somewhat schematic view illustrating the latch of the present invention installed on a closure of the fully overlapping type.
Figure 5:
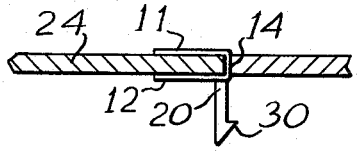
FIG. 5 is a view similar to FIG. 4 showing a flush closure.

Looking at FIGS. 4 and 5 of the drawings, it will be seen that the safety latch shown in FIGS. 1–3 of the drawings can be used on either a surface mounted closure as shown in FIG. 4 or a flush mounted closure as shown in FIG. 5 without alteration of the latch member. Since the hook assembly 15 is adjustable with respect to the bracket 10, it will be understood that the position of the hook assembly 15 can be changed, and no other adjustment is required for the two arrangements shown in FIGS. 4 and 5.

Figure 6:
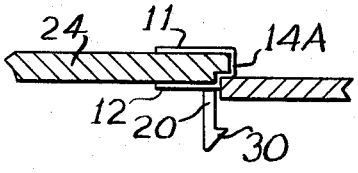
FIG. 6 is view similar to FIG. 4 but showing a rabbeted closure.

For the rabbeted closure as shown in FIG. 6 of the drawings, the only change required in the safety latch shown in FIGS. 1–3 of the drawings is to provide an offset in the end member 14. As shown in FIG. 6, the outer flange 11 and inner flange 12 are the same as those shown in FIG. 1, and the end member 14A is shown with an offset so that the end member 14A follows the rabbeted edge of the closure 24A.

The ratchet, or ratchet and pawl, arrangement has been disclosed as comprising teeth 18 on the back of the inner flange 12 and teeth 22 on the front of the plate 21. Those skilled in the art will recognize that this arrangement could be easily modified by placing teeth on the inside surface of the flange 12 and urging a pawl towards such teeth from the hook member 20. Similarly, the inside edges of the opening 19 could be provided with ratchet teeth, and the sides of the hook member 20 could carry the pawl. In this latter arrangement, either the sides of the opening 19 could spring apart, or the hook member 20 could carry appropriate spring means to urge the pawls against the ratchet teeth. Numerous other ratcheting arrangements will suggest themselves to those skilled in the art, the important feature being the adjustability of the hook member 20 with respect to the bracket 10.

It will thus be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as defined in the appended claims.

I claim:

1. A safety latch for preventing access to a cabinet or the like by preventing full opening of a closure for said cabinet, said safety latch including a mounting bracket receivable on the moveable edge of said closure, and a hook assembly carried by said mounting bracket, said hook assembly including a base plate selectively engageable with said mounting bracket, ratchet means for allowing said base plate to be moved in one direction relative to said mounting bracket while restraining motion in the opposite direction, a hook member extending generally perpendicularly from said base plate for engaging said cabinet, said hook member being sufficiently resilient to be forcefully bent for disengagement from said cabinet, said mounting bracket including an outer flange for engagement with the outer surface of said closure, an inner flange in a plane parallel to said outer flange, and an end member connecting said outer flange and said inner flange, said end member engaging said moveable edge of said closure.

2. A safety latch as claimed in claim 1, said inner flange being spaced from the inner surface of said closure sufficiently to receive said base plate between said closure and said inner flange.

3. A safety latch as claimed in claim 2, said inner flange defining an opening therein, said hook member slidably extending through said opening in said inner flange.

4. A safety latch as claimed in claim 3, said ratchet means comprising first ratchet teeth on said base plate and second ratchet teeth on said inner flange, said first ratchet teeth and said second ratchet teeth being engageable to allow said base plate to be moved towards said end member and to restrain motion away from said end member.

5. A safety latch as claimed in claim 4, said hook assembly further including guide means receivable in said opening in said inner flange for preventing canting motion of said hook assembly.

6. A safety latch as claimed in claim 5, said guide means including a knob extending from said base plate, said hook member extending from the upper end of said base plate and said knob extending from the lower end of said base plate.

7. A safety latch as claimed in claim 6, and further including latch means for holding said hook member within said opening in said inner flange, said latch means comprising flared portions on said hook member for engaging the surface of said inner flange.

8. A safety latch as claimed in claim 7, and including second latch means on said knob.

9. A safety latch as claimed in claim 1, said outer flange defining an opening therein, said opening in said outer flange to being so located and dimensioned as to allow said inner flange to be projected therethrough, the arrangement being such that said mounting bracket can be molded in one piece.

* * * * *